US010895180B2

(12) United States Patent
Alessandria et al.

(10) Patent No.: US 10,895,180 B2
(45) Date of Patent: Jan. 19, 2021

(54) VALVE LIFT CONTROL DEVICE

(71) Applicant: Eaton SRL, Milan (IT)

(72) Inventors: Marco Alessandria, Trana (IT); Massimo D'Amore, Rivoli (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 515 days.

(21) Appl. No.: 15/550,385

(22) PCT Filed: Feb. 12, 2016

(86) PCT No.: PCT/EP2016/053061
§ 371 (c)(1),
(2) Date: Aug. 11, 2017

(87) PCT Pub. No.: WO2016/131728
PCT Pub. Date: Aug. 25, 2016

(65) Prior Publication Data

US 2018/0023426 A1 Jan. 25, 2018

(30) Foreign Application Priority Data

Feb. 20, 2015 (GB) ..... 1502863.2

(51) Int. Cl.
*F01L 13/00* (2006.01)
*F01L 1/18* (2006.01)

(52) U.S. Cl.
CPC ..... *F01L 13/0005* (2013.01); *F01L 1/18* (2013.01)

(58) Field of Classification Search
CPC ..... F01L 13/0005; F01L 1/18; F01L 13/00; F01L 1/24; F01L 1/143; F01L 1/181;
(Continued)

(56) References Cited

U.S. PATENT DOCUMENTS 4,221,200 A * 9/1980 Soeters, Jr. ..... F01L 13/0005 123/198 F
4,380,219 A * 4/1983 Walsh ..... F01L 13/0005 123/198 F
(Continued)

FOREIGN PATENT DOCUMENTS

FR 53372 E * 10/1945 ..... F01L 13/0005
FR 53372 E 10/1945
(Continued)

OTHER PUBLICATIONS

International Search Report of PCT/EP2016/053061, dated May 3, 2016.

*Primary Examiner* — Devon C Kramer
*Assistant Examiner* — Kelsey L Stanek
(74) *Attorney, Agent, or Firm* — Leydig, Voit & Mayer, Ltd.

(57) ABSTRACT

A valve control device for controlling the stroke of a valve of a combustion engine includes: a first body part and a second body part, co-axially arranged, rotatably arranged relative to each other and axially displaceable between a first axial relative position and a second axial relative position; a spring for urging the first body part and the second body part away from each other; wherein the first and second body part have both axial surfaces facing each other and provided with cams evenly distributed along the circumference of the axial surface and wherein the pitch of the cams on both axial surfaces is equal; and a locking pin arranged in axial direction through the first body and extending on both sides, wherein one end of the locking pin extends through a cam.

9 Claims, 3 Drawing Sheets

(58) Field of Classification Search
CPC .... F01L 1/25; F01L 1/26; F16K 35/02; F16K 35/022; F16K 35/025; F16K 35/027; F16K 35/04; F16K 35/06; F16K 35/08; F16K 35/10; F16K 35/12; F16K 35/14; F16K 35/16
USPC ..... 123/90.39, 90.12, 90.44, 90.45
See application file for complete search history.

(56) References Cited

U.S. PATENT DOCUMENTS

| | | | | |
|---|---|---|---|---|
| 5,893,344 | A * | 4/1999 | Church | F01L 1/183 123/198 F |
| 6,311,656 | B1 * | 11/2001 | Watanabe | F01L 1/3442 123/90.17 |
| 9,512,745 | B2 * | 12/2016 | Cecur | F01L 1/267 |
| 2008/0207015 | A1 * | 8/2008 | Sueyoshi | H05K 3/325 439/75 |
| 2015/0159520 | A1 * | 6/2015 | Cecur | F01L 1/143 123/90.12 |
| 2015/0159530 | A1 * | 6/2015 | Groh | F04B 53/14 60/299 |

FOREIGN PATENT DOCUMENTS

| | | | | |
|---|---|---|---|---|
| GB | 1551360 | A | 8/1979 | |
| JP | 2012021504 | A | 2/2012 | |
| WO | WO-2014001560 | A1 * | 1/2014 | F01L 1/18 |

* cited by examiner

VALVE LIFT CONTROL DEVICE

CROSS-REFERENCE TO RELATED APPLICATIONS

This application is a U.S. national stage application under 35 U.S.C. § 371 of International Application No. PCT/EP2016/053061, filed on Feb. 12, 2016, and claims benefit to British Patent Application No. 1502863.2, filed on Feb. 20, 2015. The International Application was published in English on Aug. 25, 2016, as WO 2016/131728 A1 under PCT Article 21(2).

FIELD

The invention relates to a valve control device for controlling the stroke of a valve of a combustion engine.

BACKGROUND

A valve control device is used to control the valve lift. By being able to change the height with which a valve of a combustion engine opens, the characteristics of the engine can be changed and can be adapted to the circumstances. This has a positive effect on performance, fuel economy and/or emissions.

U.S. Pat. No. 4,380,219 discloses for example a valve control device which is mounted at the pivot axis of the rocker arm. The valve control device has two body parts, which can be rotated relative to each other and allows the pivot axis to be moved up, when the cam moves the rocker arm up. As a result, the valve will not or move over a smaller distance, then when the pivot axis of the rocker arm is blocked for upward movement.

U.S. Pat. No. 5,893,344 also discloses a similar valve control device, which acts on the pivot axis of the rocker arm.

The applicant is furthermore aware of a valve control device according to the preamble. This valve control device is typically mounted in an end of the rocker arm, i.e. in between the rocker arm and either the cam/pushrod or the valve. The first and second body part of the valve control device have cams arranged like a crown on axial surfaces facing each other. The first and second body part can rotate such that the cams of both body parts can in a first position engage with each other, or can in a second position abut with each other.

In the first position the first and second body parts can axially move, while in the second position the axial movement is blocked. As a result, the lift of a valve will be reduced with the valve control device in the first position, as part of the movement will be absorbed by the axial movement of the first and second body parts.

In order to align the cams of both body parts to allow for engagement with each other, the cams of at least one of the body parts are provided with a small protrusion, which will always be positioned between two cams of the opposite body. These protrusions ensure, that when rotating both body parts relative to each other, the rotation stops at the position, in which the cams are aligned such that engagement with each other, i.e. that the cams can slide into the space between the cams of the opposite body.

The manufacturing of a body part having an axial surface with cams, in particular in a crown shape, and additionally protrusions on the cams for stopping the rotation at the position, which allows for engagement of the cams, is difficult and involves an expensive grinding process as a result of the complex shape of the cams including the protrusions.

SUMMARY

An aspect of the invention provides a valve control device for controlling stroke of a valve of a combustion engine, the device comprising: a first body part and a second body part, co-axially arranged, rotatably arranged relative to each other, and axially displaceable between a first axial relative position and a second axial relative position; a spring configured to urge the first body part and the second body part away from each other; wherein the first and second body part each have a respective axial surfaces facing each other, wherein the first and second body part include cams evenly distributed along a circumference of the respective axial surface, wherein a pitch of the cams on both axial surfaces is equal, and wherein a locking pin is arranged in axial direction through the first body and extending on both sides thereof, one end of the locking pin extending through a first cam of the cams.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
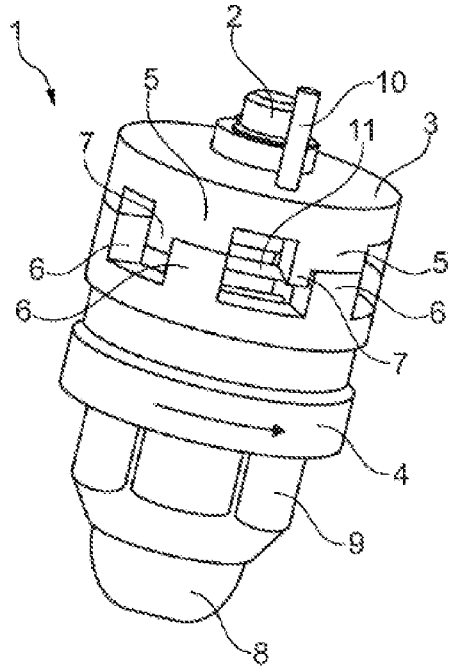
Fig. 1 PRIOR ART
FIG. 1 an embodiment of a valve control device according to the prior art.

An aspect of the invention relates to a valve control device for controlling the stroke of a valve of a combustion engine, which device comprises: a first body part and a second body part, co-axially arranged, rotatably arranged relative to each other and axially displaceable between a first axial relative position and a second axial relative position; spring means for urging the first body part and the second body part away from each other; wherein the first and second body part have both axial surfaces facing each other and provided with cams evenly distributed along the circumference of the axial surface and wherein the pitch of the cams on both axial surfaces is equal.

An aspect of the invention provides a valve control device in which the above mentioned disadvantages are reduced.

An aspect of the invention provides a valve control device characterized by a locking pin arranged in axial direction through the first body and extending on both sides, wherein one end of the locking pin extends through a cam.

In order to lock the first body part relative to for example a rocker arm allowing for only engaging on the second body part for rotation, a locking pin extends with a second end into a hole arranged in the rocker arm. This will block rotation of the first body part relative to the rocker arm.

The one end of the locking pin extending through a cam of the first body provides a protrusion, similar to the prior art valve control devices, in which a protrusion was provided by grinding the cams. However, with the invention, a simple through hole is provided in the first body, in which the locking pin is pushed. This is a simpler and less expensive manufacturing process compared to the prior art.

The locking pin should according to the invention extend through a cam of the first body part to ensure, that the cams of the first body part can still engage with the cams of the second body part. If the locking pin would be extending between two cams of the first body part, the locking pin will block the space, in which a cam of the second body part should slide.

In a preferred embodiment of the valve control device according to the invention at least part of the circumferential surface of the one end of the locking pin is in line with a radial side surface of the cam, through which the locking pin extends.

In this embodiment, the second body part can be rotated relative to the first body part, such that the extending end of the locking pin will be in contact with a side surface of a cam of the second body part. This will ensure that, as the circumferential surface of the locking pin is in line with a radial side surface of the cam, the cam of the first body part can just slide along the cam of the second body part.

In another embodiment of the valve control device according to the invention, the locking pin is provided with a flange, wherein at least part of the circumferential surface of the flange is in line with the radial side surface of the cam.

If drilling a through hole just along the radial side surface of the cam proves to be too difficult, the through hole can be arranged at a distance from this radial side surface. The flange at the end of the locking pin can then ensure that still a part of the circumferential surface flange is in line with the radial side surface of the cam.

Another preferred embodiment of the valve control device according to the invention, further comprises an axle along which the first body part and second body part are relatively displaceable.

The axle provides a guide for both body parts and can also limit the stroke of the relative movement of the body parts, for example by a locking ring arranged at a suitable position on the axle.

In yet another embodiment of the valve control device according to the invention, the second body comprises a semi-spherical surface on the axial surface opposite of the axial surface provided with the cams.

The semi-spherical surface can be a direct contact surface with a cam of the valve train or with a valve stem.

Preferably, the cams are block shaped. This allows for a relative large top surface to which the cams can abut to each other and allows for taking up the lifting force of the cam of the valve train.

The invention also relates to a combination of a rocker arm of a valve train of a combustion engine and a valve control device according to the invention, wherein the first and second body parts of the valve control device are arranged in a first end of the rocker arm and wherein the other end of the locking pin extends into the rocker arm, to lock rotation of the first body relative to the rocker arm.

Preferably, the combination according to the invention further comprises an actuator arranged on the rocker arm for rotating the second body part relative to the first body part. Typically, such an actuator will be actuated by hydraulic pressure and will be in the form of a piston.

In a preferred embodiment of the combination according to the invention the rocker arm is provided with a cylindrical cavity and at least the second body part has a substantially cylindrical outer surface to allow rotation within the cylindrical cavity.

FIG. 1 shows an embodiment of a valve control 1 device according to the prior art.

The valve control device 1 has an axle 2 around which a first body part 3 and a second body part 4 are arranged. The second body part 4 can rotate around the axle 2 relative to the first body part 3.

The first body part 3 is at the bottom axial surface provided with cams 5, which provide more or less a crown shape, also the second body part 4 is provided with cams 6 at the top axial surface, also providing a more or less crown shape.

In order to align the cams 5, 6 of the first body part 3 and second body part 4, the cams 5 are provided with protrusions 7. The protrusions 7 allow the second body part 4 to be rotated over a defined path.

The second body part 4 is furthermore provided at the bottom with a semi-spherical axial surface 8 and a hexagonal circumferential surface 9 for engagement of an actuator.

The first body part 3 has a locking pin 10 extending from the top axial surface which locking pin 10 is intended for locking rotation of the first body part 3 relative to for example a rocker arm.

On the inside of the valve control device 1, a spring 11 is provided around the axle 2 to urge the first body part 3 and the second body part 4 away from each other.

Figure 2:
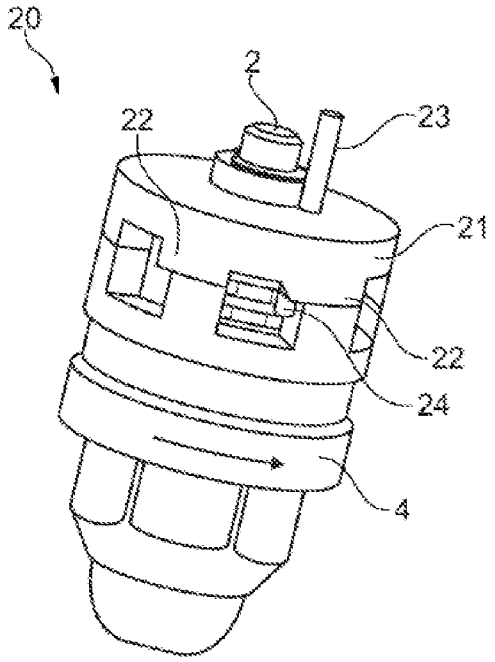
FIG. 2 a perspective view of an embodiment of a valve control device according to the invention.

FIG. 2 shows a perspective view of an embodiment of a valve control device 20 according to the invention.

The embodiment of the valve control device 20 according to the invention has parts in common with the embodiment according to the prior art as shown in FIG. 1 and corresponding parts are provided with corresponding reference signs.

The valve control device 20 has a different shaped first body part 21 with cams 22 providing a more or less crown shape. The first body part 21 is arranged around the axle 2 and the second body part 4, also arranged around the axle 2, can rotate relative to the first body part 21.

To lock rotation of the first body part 21 relative to for example a rocker arm, a locking pin 23 is provided. This locking pin 23 extends through a cam 22 and extends on both sides out of the first body part 21. As a result, the first end 24 of the locking pin 23 provides the same function as the protrusions 7 of the valve control device 1 according to the prior art.

Figure 3:
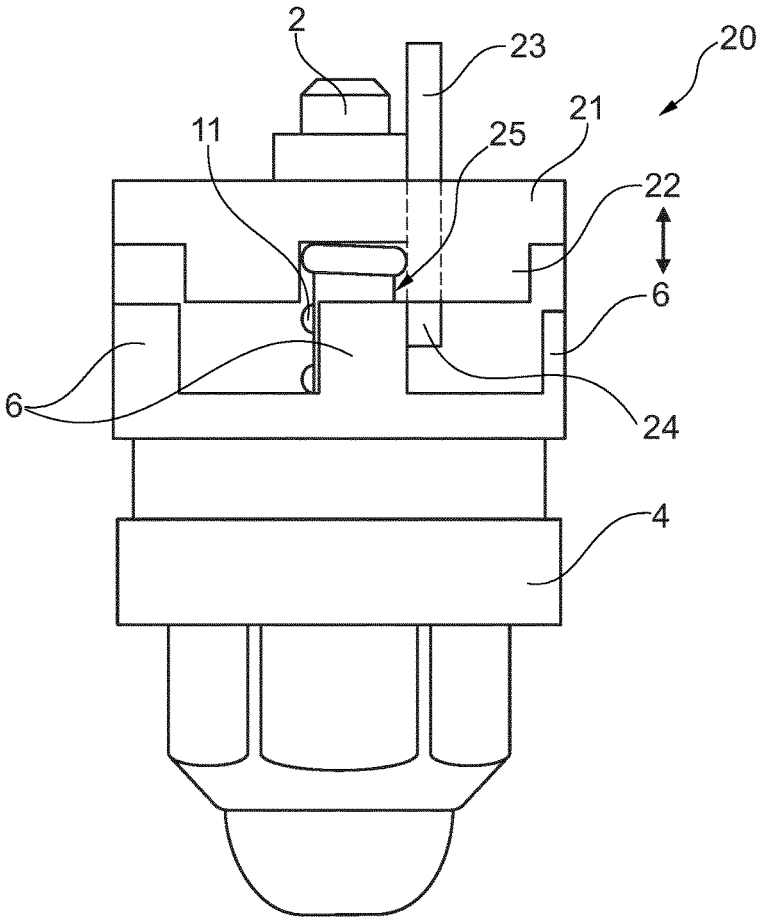
FIG. 3 a side view of the embodiment of FIG. 2.

FIG. 3 shows a side view of the embodiment of the valve control device 20 of FIG. 2. In this FIG. 3, the second body part 4 has been rotated relative to the first body part 21 such that the cams 22 are aligned with the slots between the cams 6 and vice versa. This allows for up and down movement of the first and second body part 21, 4 relative to each other. The first end 24 of the locking pin extends through the cam 22. The circumferential surface of the first end 24 is in line with the radial surface 25 of the cam 22. This ensures that when the second body part 4 is rotated to the position in which the first end 24 abuts a cam 6, the cams 22 are perfectly aligned with the slots between the cams 6.

Figure 4:
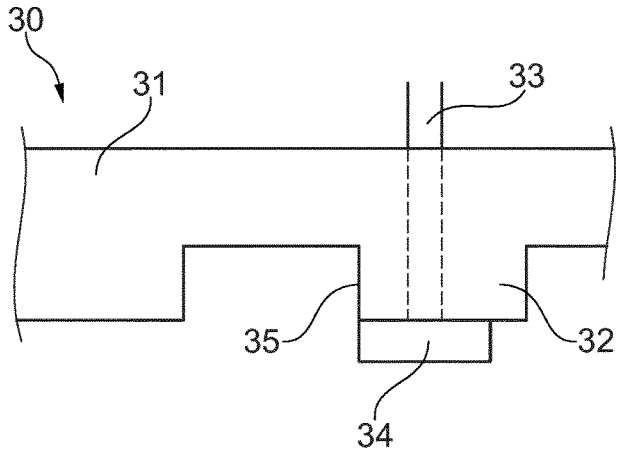
FIG. 4 partially a second embodiment of a valve control device according to the invention.

FIG. 4 shows partially a second embodiment of a valve control device 30 according to the invention. In this embodiment, the first body part 31 is again provided with cams 32. The locking pin 33 extends through the first body part 31 and a cam 32. The first end of the locking pin 33 is provided with a flange 34 such that at least part of the circumferential surface of the flange 34 is in line with the radial surface 35 of the cam 32.

Figure 5:
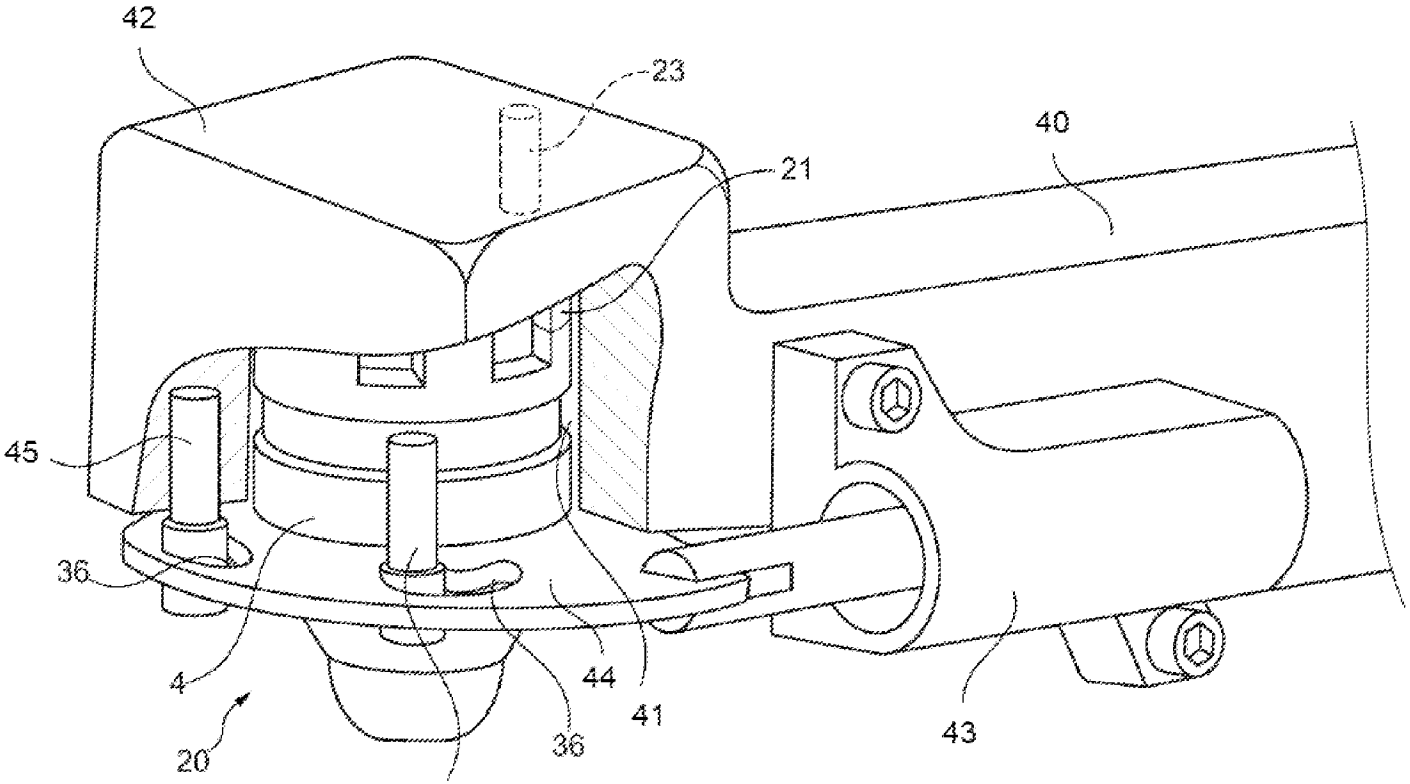
FIG. 5 an embodiment of a combination according to the invention.

FIG. 5 shows an embodiment of a combination according to the invention with a rocker arm 40 and a valve control device 20 arranged in a cylindrical space 41 in the first end 42 of the rocker arm 40. The locking pin 23 is inserted in the rocker arm 40 such that the first body part 21 of the control device 20 cannot rotate relative to the rocker arm 40. The rotation of the second body part 4 is controlled by an actuator 43, preferably a hydraulic actuator, which is coupled via a coupling plate 44 to the hexagonal circumferential surface 9 of the second body part 4.

The movement and rotation of the coupling plate 44 is guided by bolts 45 arranged in the first end 42 of the rocker arm 40 and slots 36 arranged in the coupling plate 44.

The actuator 43 can drive the valve control device 20 into the position as shown in FIG. 2 or into the position as shown in FIG. 3 and therewith control the valve lift of the corresponding valve.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A valve control device for controlling stroke of a valve of a combustion engine, the device comprising:

a first body part and a second body part, co-axially arranged, rotatably arranged relative to each other, and axially displaceable between a first axial relative position and a second axial relative position;

a spring configured to urge the first body part and the second body part away from each other;

wherein the first and second body part each have a respective axial surface facing each other, wherein the first and second body parts include cams evenly distributed along a circumference of the respective axial surface, wherein a pitch of the cams on both axial surfaces is equal, and wherein a locking pin is arranged in an axial direction through the first body part and extending on both sides thereof, one end of the locking pin extending through a first cam of the cams.

2. The valve control device of claim 1, further comprising:

an axle along which the first body part and second body part are displaceable relative to one another.

3. The valve control device of claim 2, wherein the second body part includes a semi-spherical surface on an axial surface that is opposite the respective axial surface of the second body part.

4. The valve control device of claim 1, wherein the cams are block shaped.

5. A combination, comprising:

a rocker arm of a valve train of a combustion engine; and the valve control device of claim 1, wherein the first and second body parts of the valve control device are arranged in a first end of the rocker arm, and wherein a second end of the locking pin extends into the rocker arm, so as to lock rotation of the first body relative to the rocker arm.

6. The combination of claim 5, further comprising:

an actuator arranged on the rocker arm, configured to rotate the second body part relative to the first body part.

7. The combination of claim 5, wherein the rocker arm includes a cylindrical cavity, and wherein at least the second body part includes a cylindrical outer surface to allow rotation within the cylindrical cavity of the rocker arm.

8. A valve control device for controlling stroke of a valve of a combustion engine, the device comprising:

a first body part and a second body part, co-axially arranged, rotatably arranged relative to each other, and axially displaceable between a first axial relative position and a second axial relative position;

a spring configured to urge the first body part and the second body part away from each other;

wherein the first and second body part each have a respective axial surface facing each other, wherein the first and second body parts include cams evenly distributed along a circumference of the respective axial surface, wherein a pitch of the cams on both axial surfaces is equal, wherein a locking pin is arranged in an axial direction through the first body part and extending on both sides thereof, one end of the locking pin extending through a first cam of the cams, and wherein at least part of a circumferential surface of the one end of the locking pin is in line with a radial side surface of the first cam, through which the locking pin extends.

9. The valve control device of claim 8, wherein the locking pin includes a flange, wherein at least part of a circumferential surface of the flange is in line with the radial side surface of the first cam.

* * * * *